US005503326A

United States Patent [19]

Stonehouse

[11] Patent Number: 5,503,326

[45] Date of Patent: Apr. 2, 1996

[54] ICE CREAM CARTON

[75] Inventor: Donald B. Stonehouse, Kenosha, Wis.

[73] Assignee: Field Container Company, L.P., Elk Grove Village, Ill.

[21] Appl. No.: 500,546

[22] Filed: Jul. 11, 1995

[51] Int. Cl.[6] ..... B65D 5/22; B65D 5/68

[52] U.S. Cl. ..... 229/132; 229/3.1; 229/145; 229/905; 229/920

[58] Field of Search ..... 229/3.1, 132, 136, 229/145, 227, 905, 920

[56] References Cited

U.S. PATENT DOCUMENTS

| | | | |
|---|---|---|---|
| Re. 33,204 | 4/1990 | Froom | 229/905 |
| 2,670,128 | 2/1954 | Stowitts | 229/132 |
| 3,144,978 | 8/1964 | Asman | 229/132 |
| 3,946,937 | 3/1976 | Forbes, Jr. et al. | 229/132 |
| 4,141,485 | 2/1979 | Lambert | 229/132 |
| 4,159,076 | 6/1979 | Engdahl, Jr. | 229/132 |
| 4,431,129 | 2/1984 | Froom | 229/905 |
| 4,508,226 | 4/1985 | Davis et al. | 229/132 |
| 5,097,958 | 3/1992 | Josephs et al. | 229/905 |
| 5,409,160 | 4/1995 | DeMay | 229/905 |

*Primary Examiner*—Gary E. Elkins

*Attorney, Agent, or Firm*—Marshall, O'Toole, Gerstein, Murray & Borun

[57] ABSTRACT

A carton for containing ice cream has cover, top, rear, bottom and front panels and right and left end flaps on each of the cover, top, rear, bottom and front panels. The bottom panel end flaps are designed to be folded to seal the end of the carton such that the upper edges of those bottom panel end flaps contact lines of juncture between the top panel and the top panel end flaps. The bottom panel end flaps have a line of weakness adjacent the upper edge which permits bending of that flap when ice cream in the carton expands. The front panel end flaps overlie the bottom panel end flaps when the carton is sealed, but the upper edge of the front panel end flaps is below the line of weakness on the bottom panel end flaps so as not to interfere with the bowing of the bottom panel end flaps.

20 Claims, 4 Drawing Sheets

ICE CREAM CARTON

BACKGROUND

1. Field of Invention

The present invention relates generally to cartons for ice cream and the like, and more particularly to structures for effectively sealing the ends of such cartons.

2. Background Art

Conventional ice cream cartons generally consist of front, bottom, back, top and cover panels hingedly connected to each other. When forming the carton from a carton blank, the front panel and cover panel are glued to each other to form a rectangular tube. Each of the panels has a right and a left end flap associated therewith which are folded one at a time so as to be generally perpendicular with the panels in order to close each end of the rectangular tube. Because these cartons often contain liquid or semi-frozen liquid such as ice cream, it is important to form a good seal around the edges of the end flaps where those edges contact the panels. Absent a good seal, the contents of the carton may leak causing an undesirable appearance and possibly damaging other goods.

It is also important to have a good seal between the upper edge of the front panel and the line of juncture or hinge between the top panel and cover panel of the carton. Previously, applicant has formed such a seal by providing a line of weakness in the front panel adjacent the edge of that panel which contacts the line of juncture between the top panel and the cover panel. This line of weakness permits the front panel to bow slightly when the liquid material placed in the carton freezes and expands. The bowing of the panel permits the top edge of that front panel to remain at the line of juncture, thereby exhibiting a better seal. Absent the line of weakness, the expanding material in the carton might put pressure on the front panel and interfere with the seal between the top of that panel and the line of juncture.

A line of weakness has not heretofore been used on end flaps to create a better seal between those end flaps and the panels or their hinges. When the five end flaps on each side of the carton are folded onto each other and adhered, there may be as many as three or even four end flaps layered over each other at any one position. The numerous layers of end flaps provide a great deal of stiffness in those locations. Thus, it has not been desirable to place a line of weakness on any of the end flaps, since there would be one or more other end flaps present to prevent bowing at that line of weakness.

SUMMARY OF THE INVENTION

There is provided in accordance with the present invention a carton of the type which can be used for containing ice cream which has a plurality of panels connected to each other. A first end flap is connected to a first panel and a second end flap is connected to a second panel. A first edge on the first end flap contacts a portion of the carton and a line of weakness on the first end flap is adjacent that first edge. A second edge on the second end flap is generally parallel of the first edge. The line of weakness is between the first edge and the second edge, when the second panel end flap overlies the first panel end flap so that the line of weakness is not covered by the second panel.

In accordance with another aspect of the present invention, the plurality of panels may include cover, top, rear, bottom and front panels. Right and left end flaps may be attached to each of the cover, top, rear, bottom and front panels. The bottom panel may be the first panel and the front panel may be the second panel such that an edge on the bottom panel contacts a fold line between the top panel and a top panel end flap.

A hinge may connect the first or bottom panel end flap to the first or bottom panel and a third edge on the first panel end flap may be located away from the hinge when the second or front panel overlies the first or bottom panel. The line of weakness may extend from the third edge toward the hinge. The first edge on the first or bottom panel end flap and the third edge on the first or bottom panel end flap intersect at a corner and the line of weakness may extend toward the corner in the area of the corner. The line of weakness may terminate about one inch (2.54 cm) from the hinge. A second end section in the line of weakness may extend towards the first edge.

The second edge on the second or front panel end flap may have a first part generally parallel to the first edge on the first or bottom panel end flap, a second part askew to that first edge, and a third part generally parallel to that first edge. The first part may be approximately 3/64 inch (0.12 cm) from the first edge. The line of weakness may be approximately 1/64 inch (0.04 cm) from the third portion when the flaps are folded.

The first edge may contact the carton along a line of juncture between a panel such as the top panel and an end flap such as a top panel end flap. The carton may also have a third end flap and a fourth end flap, where the first and second end flaps close a right side of the carton and the third and fourth end flaps close a left side of the carton.

Other features and advantages are inherent in the carton of the present invention or will become apparent to those skilled in the art from the following detailed description in conjunction with the accompanying diagrammatic drawings.

DETAILED DESCRIPTION

Figure 1:
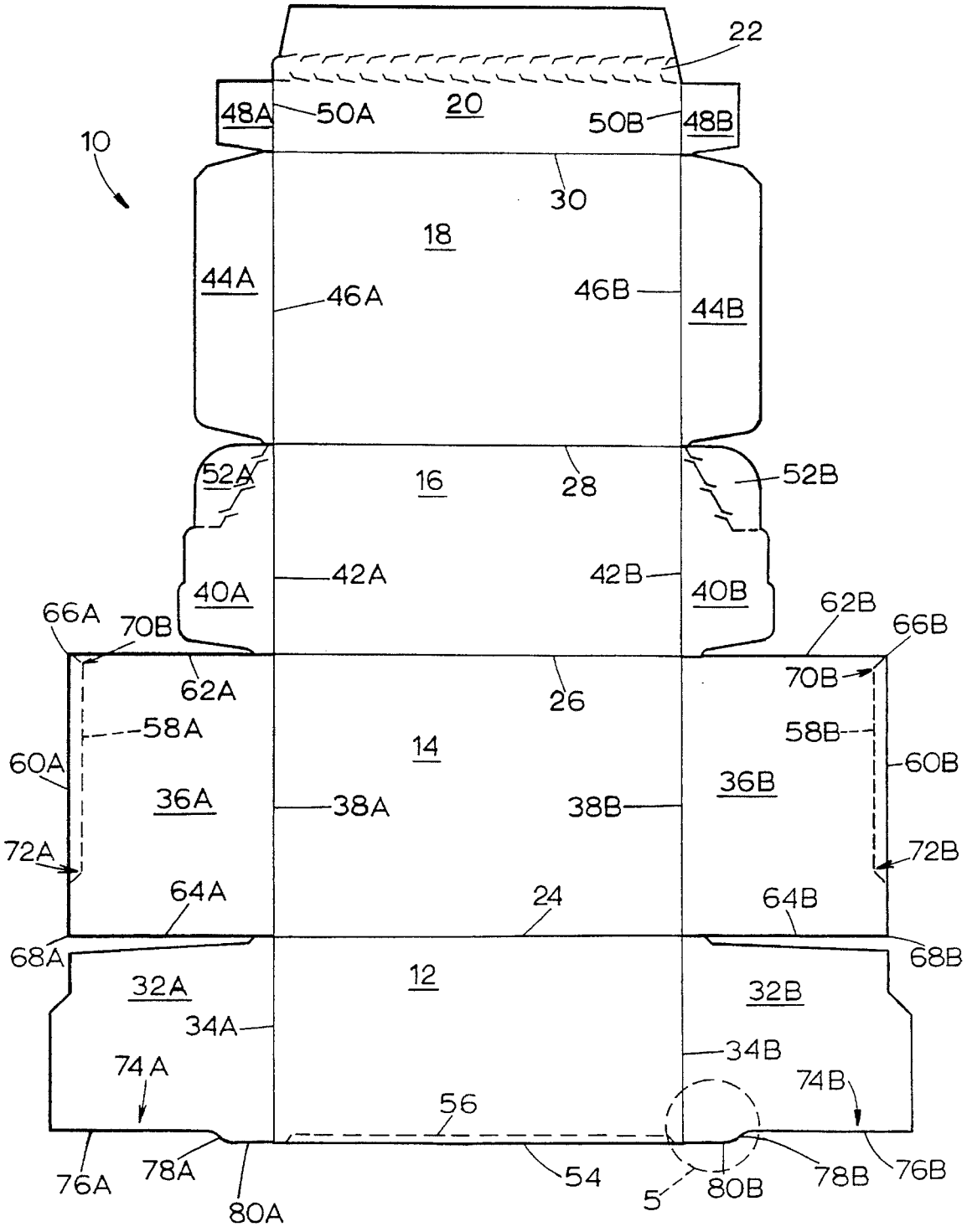
FIG. 1 is a plan view of an unassembled carton of the present invention.

Referring initially to FIG. 1, the carton of the present invention indicated generally at 10 has a front panel 12, a bottom panel 14, a back panel 16, a top panel 18 and a cover panel 20. The cover panel 20 has a tear tab 22 running across its length which is used to open the carton after it has been filled and sealed. The panels are connected by lines of juncture or hinges which permit the panels to be folded with respect to each other. The front panel 12 is connected to the bottom panel 14 by a hinge 24, the bottom panel 14 is connected to the back panel 16 by a hinge 26, the back panel 16 is connected to the top panel 18 by a hinge 28, and the top panel 18 is connected to the cover panel 20 by a hinge 30.

Each panel has a right and left end flaps connected to the panel by a lines of juncture or hinges. The front panel 12 is connected to front panel end flaps 32A and 32B by hinges 34A and 34B. The bottom panel 14 is connected to bottom panel end flaps 36A and 36B by hinges 38A and 38B. The back panel 16 is connected to back panel end flaps 40A and 40B by hinges 42A and 42B. The top panel 18 is connected to top panel end flaps 44A and 44B by hinges 46A and 46B. The cover panel 20 is connected to cover panel end flaps 48A and 48B by hinges 50A and 50B. The back panel end flaps 40A-B each have a teartab 52A and 52B which separate from the remainder of the back panel end flaps 40A-B when the carton is opened.

Adjacent an edge 54 of the front panel 12 is a line of weakness 56. When the carton blank of FIG. 1 is folded, the edge 54 engages the hinge 30 between the top panel 18 and the cover panel 20 to form a seal. When ice cream is placed into the carton, the ice cream may expand, thus putting pressure along the line of weakness 56 resulting in bowing. The bowing at the line of weakness 56 helps keep the edge 54 in place along the hinge 30 to maintain a seal which might otherwise allow leakage of the expanding ice cream.

Each bottom panel end flap 36A-B has a line of weakness 58A and 58B adjacent an edge 60A or 60B respectively. The lines of weakness may be formed in a variety of ways, but preferably by placing a fifty-percent cut through the carton material on the side of the carton which will face outward when the carton is assembled. Each bottom panel end flap 36A-B also has an edge 62A or 62B and an edge 64A or 64B. The edges 60A-B and 62A-B intersect at corners 66A or 66B. The edges 60A-B and the edges 64A-B intersect at corners 68A or 68B. The lines of weakness 58A-B are generally parallel to the edges 60A-B except at or near the ends of the lines of weakness. At or near the first ends of the lines of weakness 58A-B indicated generally at 70A and 70B, the lines of weakness are angled so as to extend towards the corners 66A-B. The second ends 72A and 72B of the lines of weakness 58A-B are also angled toward the edges 60A-B, but are not adjacent the corners 68A-68B, because the lines of weakness terminate prior to reaching the edges 64A-B.

The front panel end flaps 32A-B have edges 74A or 74B, respectively. Each edge 74A-B has three sections, a first section 76A or 76B, which is generally parallel to the edge 54, a second section 78A or 78B, which is not parallel to the edge 54, and a third section 80A or 80B, which is generally parallel to the edge 54.

Figure 2:
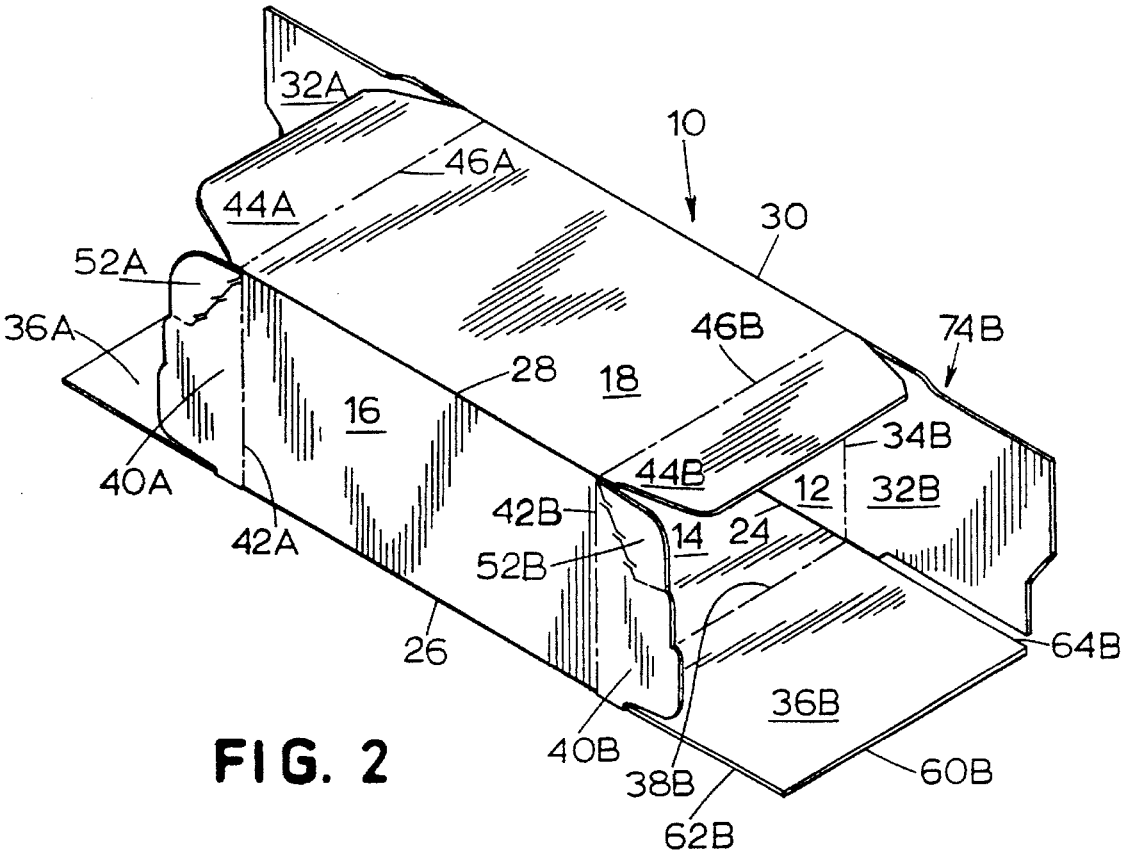
FIG. 2 is a perspective view of the carton of FIG. 1 in a partially assembled configuration.
Figure 3:
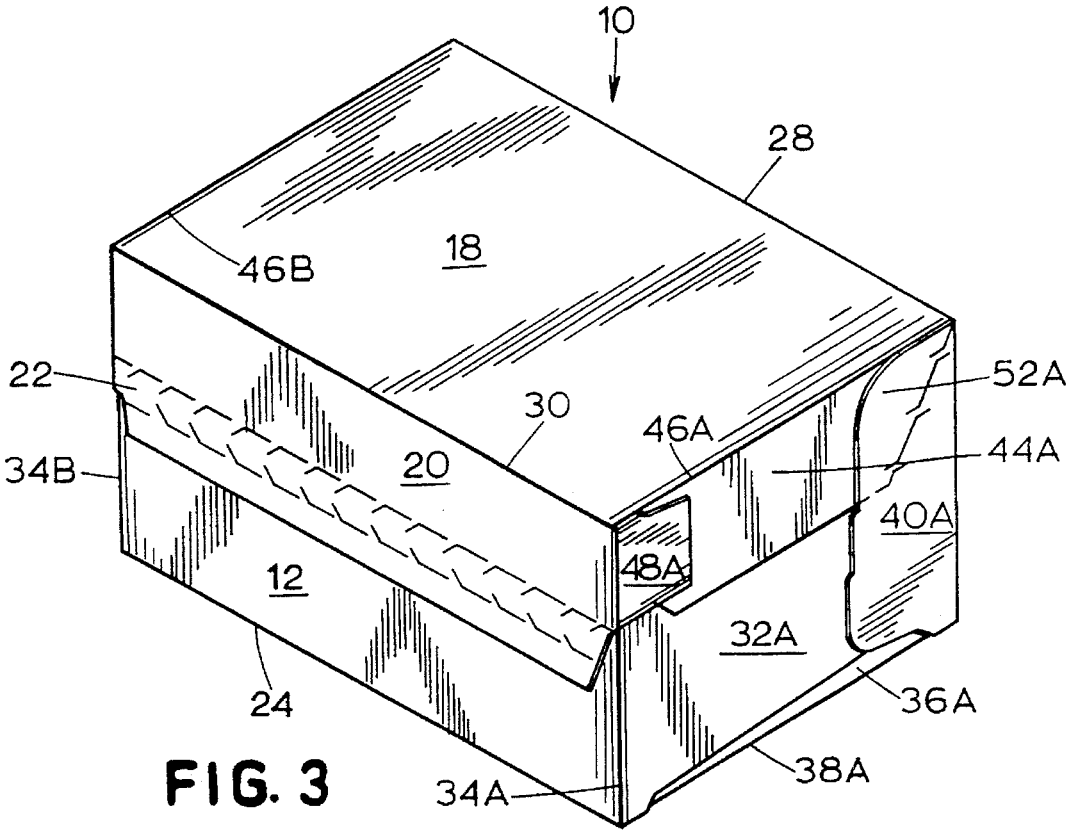
FIG. 3 is a perspective view of the carton of FIG. 2 in its fully assembled configuration.

Referring now to FIGS. 2 and 3, the carton 10 is assembled by adhering the bottom portion of cover panel 20 to the front panel 12. A rectangular tube as shown in FIG. 2 is thereby formed where the right and left ends are open. Either side of the carton can then be closed, but one side is generally completely closed and sealed before the other side is closed. The bottom panel end flap 36 is first folded in so that the edge 60 is in contact with the hinge 46. The front panel end flap 32 is then folded to overlie the bottom panel end flap 36. The top panel end flap 44 is then folded down to cover portions of the bottom panel end flap 36 and the front panel end flap 32. Adhesive (not shown) is next applied by placing a line of glue from the top of the carton to the bottom of the carton near the back of the carton along portions of the front panel end flap 32, the bottom panel end flap 36 and the top panel end flap 44. The rear panel end flap 40 is then folded to cover portions of the bottom panel end flap 36, the front panel end flap 32 and the top panel end flap 44. A small amount of adhesive is also placed near the front of top panel end flap 44 and the cover panel end flap 48 is then folded over and adhered to the cover panel end flap 44.

Once one end of the carton 10 is sealed, it is set on the sealed end and filled through the other, open end with ice cream or other products. The second end is then sealed using the same procedure as used with the first end to produce a carton as shown in FIG. 3, after which the carton 10 and its contents are frozen. When consumers want to open the carton, they remove the tear tab 22 and lift the cover panel 20 and top panel 18 from the rest of the carton. When the cover panel 20 and top panel 18 are lifted, the cover panel end flaps are also lifted, causing the tab 52 to separate from the rest of the rear panel end flap 40.

Figure 8:
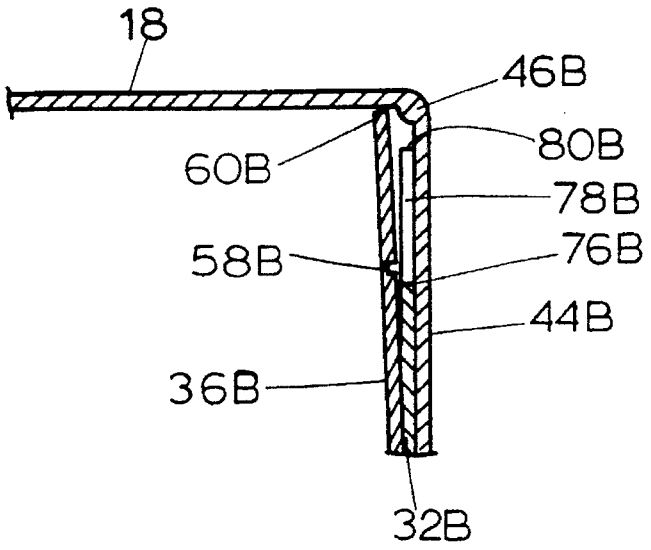
FIG. 8 is a sectional view of the carton taken along the lines 6—6 of FIG. 4 with the top panel end flap fold down.
Figure 9:
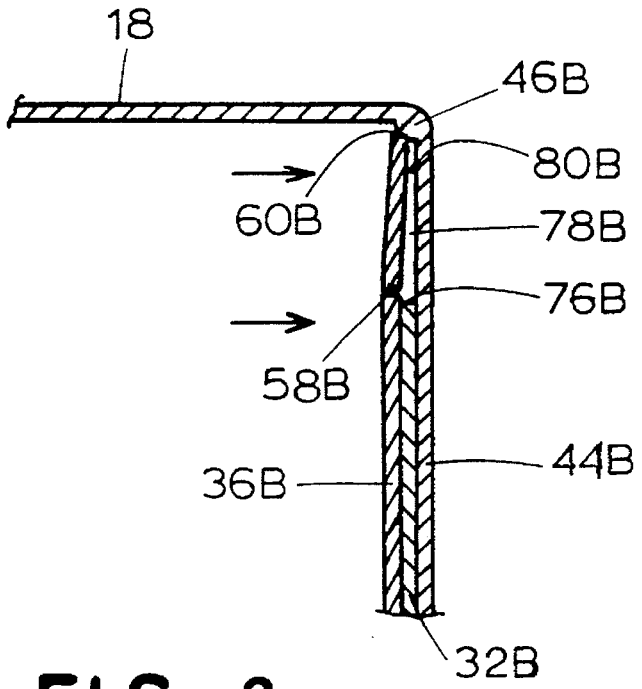
FIG. 9 is a sectional view of the carton as shown in FIG. 8 after the carton is filled.

FIGS. 4–9 show the relationship of various elements of the carton 10 in a partially assembled configuration. In each of FIGS. 4–7, the carton is at the stage in construction where the bottom panel end flap 36 and front panel end flap 32 have been folded in, but none of the other end flaps have been folded in, nor has any adhesive been applied. FIG. 8 shows the carton 10 with the top panel end flaps 44 folded down, and FIG. 9 shows the carton 10 with all flaps folded down and the carton filled. Although the right side of the carton is shown in FIGS. 4–9, the structure and procedure for sealing the carton is the same for the left side.

Figure 4:
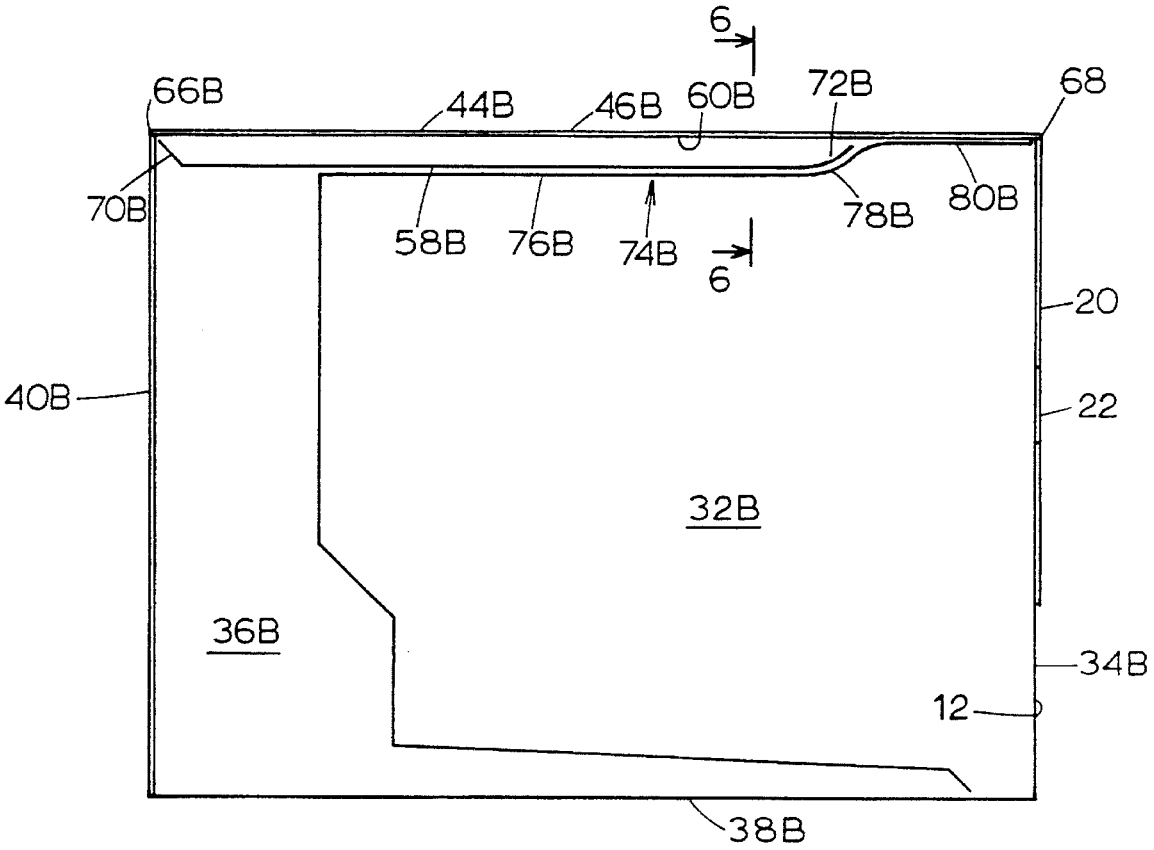
FIG. 4 is a side view of a partially assembled carton of the present invention.
Figure 5:
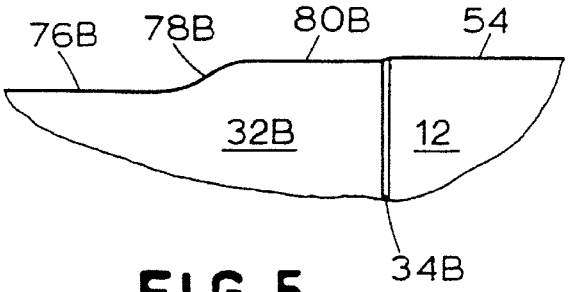
FIG. 5 is an enlarged view of a portion of a front panel and a front panel end flap of the carton of the present invention.

As can be seen best from FIG. 4, the line of weakness 58 is generally parallel to both the edge 60 and the hinge 46. The first end 70 of the line of weakness 58 angles toward the corner 66. The second end 72 of the line of weakness 58 angles toward the edge 60 and the hinge 46. The line of weakness 58 is shown between the edge 76 of the front panel end flap 32 and the edge 60, because the front panel end flap 32 does not overlie the line of weakness 58. When the top panel end flap 44 is folded over and adhered to the front panel end flap 32, there will be a small planar space between the top panel end flap 44 and the line of weakness 58 due to the thickness of the front panel end flap 32. Thus there will not be a panel contacting the line of weakness 58 in such a manner that it would prevent bending.

The edge 74 is generally parallel to the line of weakness 58 throughout its length. At the second end 72 of the line of weakness 58, the second section 78 of the edge 74 follows the direction of the second end and curves upward. After the line of weakness 58 terminates, the edge 74 in its third section 80 continues parallel to the edge 60 and hinge 46. The third section 80 is much closer to the hinge 46 than is the first section 76 of the edge 74, but the third section 80 does not contact the hinge 46. As can best be seen in FIG. 7, the height (measured from the bottom of the carton to the top of the carton) of the bottom panel end flap 36 is substantially the same as the height of the front panel 12. The height of the front panel end flap 32 in the area of its hinge 34 is slightly less than the height of the bottom panel end flap 36 and the front panel 12. Thus the third section 80 of the edge 74 does not contact the hinge 46 (nor does any other section of the edge 74). The small space between the hinge 46 and the third section 80 of the edge 74 permits a small amount of bowing of the bottom panel end flap 36 in the area of corner 68.

Figure 6:
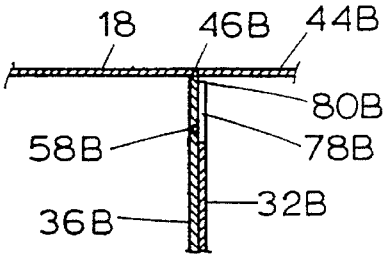
FIG. 6 is a sectional view taken along the lines 6—6 of FIG. 4.
Figure 7:
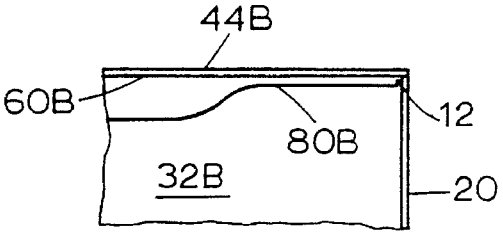
FIG. 7 is an enlarged view of a portion of the carton shown in FIG. 4.

As can be seen from FIG. 6, the edge 60 of the bottom panel end flap 36 is placed in the area of hinge 46 before the top panel end flap 44 is folded down. When the top panel end flap 44 is folded as shown in FIG. 8, the bottom panel end flap 36 tends to be displaced from the hinge 46. The hinge 46 becomes slightly expanded and rounded due to the bending of the top panel end flap 44 with respect to the top panel 18 and this may additionally displace the edge 60. If the panels were to maintain the configuration shown in FIG. 8, there would be an opportunity for ice cream or other material to pass between the top edge 60 of the bottom panel end flap 36 and the top panel 18. However, as can be seen from FIG. 9, the expansion of the ice cream when it is frozen, as shown by the arrows, forces the top edge 60 of the bottom panel end flap 36 into the expanded portion of the hinge 46. The line of weakness 58 facilitates the movement of the edge 60 by allowing the bottom panel end flap 36 to bend towards the hinge 46. Since the front panel end flap 32 does not extend all the way to the hinge 46, there is room for the bottom panel end flap 36 to bend and contact the hinge 46. The contact between the hinge 46 and the edge 60 thereby forms a seal to resist the flow of material out of the carton in the area of the hinge 46.

The carton of the present invention can be made of any material suitable for ice cream cartons. Preferably the carton will be made of 0.023 inch thick cardboard stock which have a coating of varnish or wax. The height of the bottom panel end flaps 36 may be about 3 15/32 inches (8.89 cm) and the height of the front panel 12 may be about 3½ inches (8.89 cm). The height of the front panel end flaps 32 may be about 3 29/64 inches (8.811 cm) so that the distance between the top edge of the front panel end flap and the top of the bottom panel end flap when they are folded in is about 3/64 inch (0.12 cm). The lines of weakness 58 on the bottom panel end flaps 36 may be about 13/64 inch (0.52 cm) below the top edge 60 of the bottom panel end flap 36. The first sections 76 of the edges 74 of the front panel end flaps 32 may be about 3/16 inch (0.48 cm) below the third sections 80 of the edges 74. Thus the first sections 76 will be about 1/64 inch (0.04 cm) below the lines of weakness 58 when the panels are folded in. The lines of weakness 58 may terminate about 1.03 inches (2.61 cm) from the edges 64 of the bottom panel end flaps 36.

The foregoing detailed description has been given for clearness of understanding only, and no unnecessary limitations should be understood therefrom, as modifications will be obvious to those skilled in the art. In addition, the line of weakness has been shown on the bottom panel end flap, but could be used on other end flaps that have edges which must be sealed against other portions of the carton.

I claim:

1. A carton comprising:

a plurality of panels connected to each other;

a first panel end flap connected to a first panel and a second panel end flap connected to a second panel;

a first edge on the first panel end flap which can contact a portion of the carton when the carton is assembled;

a line of weakness on the first panel end flap adjacent the first edge;

a second edge on the second panel end flap which is generally parallel with the first edge when the carton is assembled;

wherein the line of weakness is between the first edge and the second edge when the second panel end flap overlies the first panel end flap so that the line of weakness is not covered by the second panel.

2. The carton of claim 1 comprising:

cover, top, rear, bottom and front panels; and right and left end flaps attached to each of the cover, top, rear, bottom and front panels;

wherein the bottom panel is the first panel, the front panel is the second panel and the first edge contacts a fold line between the top panel and a top panel end flap.

3. The carton of claim 1 comprising:

a hinge connecting the second end flap to the second panel; and a third edge on the first panel end flap located distal from the hinge when the second panel end flap overlies the first panel end flap;

wherein the line of weakness extends from the third edge toward the hinge.

4. The carton of claim 3 wherein:

the first edge of the first panel end flap and the third panel edge on the first end flap intersect at a corner; and the line of weakness extends toward the corner in the area of the corner.

5. The carton of claim 3 wherein the line of weakness terminates about one inch (2.54 cm) from the hinge.

6. The carton of claim 5 comprising a second end section in the line of weakness that extends towards the first edge.

7. The carton of claim 1 wherein the second edge comprises a first part generally parallel to the first edge, a second part askew to the first edge and a third part generally parallel to the first edge.

8. The carton of claim 7 wherein the first part is approximately 3/64 inch (0.12 cm) from the first edge.

9. The carton of claim 8 wherein the line of weakness is approximately 1/64 inch (0.04 cm) from the third part when the flaps are folded.

10. The carton of claim 1 wherein the first edge contacts the carton along a line of juncture between a panel and an end flap.

11. The carton of claim 1 comprising:

a third panel end flap and fourth panel end flap;

wherein the first and second panel end flaps close a right side of the carton and the third and fourth panel end flaps close a left side of the carton.

12. A rectangular ice cream carton comprising:

cover, top, rear, bottom and front panels;

right and left end flaps on each of the bottom and front panels;

first edges on each of the bottom panel end flaps;

lines of weakness on each of the bottom panel end flaps adjacent the first edges;

second edges on each of the front panel end flaps which are generally parallel with the first edges on the bottom panel end flaps when the carton is constructed;

wherein the lines of weakness are between the first edges and the second edges when the front panel end flaps overlie the bottom panel end flaps so that the lines of weakness are not covered by the first panel end flaps.

13. The carton of claim 12 comprising:

hinges connecting the second panel end flaps to the second panels;

third edges on each of the bottom panel end flaps located distal from the hinges when the front panel end flaps overlie the bottom panel end flaps; and a first end portion on the line of weakness which extends from the third edge towards the hinge.

14. The carton of claim 13 wherein:

the first edge on the bottom panel end flap and the third edge on the bottom panel end flap intersect at a corner; and the line of weakness extends towards the corner in the area of the corner.

15. The carton of claim 13 wherein the line of weakness terminates about 1 inch from the hinge.

16. The carton of claim 15 comprising a second end section in the line of weakness that extends toward the first edge.

17. The carton of claim 13 wherein the second edge comprise a first part generally parallel to the first edge of the bottom panel end flap, a second part askew to the first edge of a bottom panel end flap and a third part generally parallel to the first edge of the bottom panel end flap.

18. The carton of claim 17 wherein the first part is approximately 3/64 inch (0.12 cm) from the first edge.

19. The carton of claim 18 wherein the line of weakness is approximately 1/64 inch (0.04 cm) from the third part when the flaps are folded.

20. The carton of claim 13 comprising:

end flaps on the top panel; and lines of juncture between the top panel and top panel end flaps;

wherein the first edges contact the carton along the lines of juncture between the top panel and the top panel end flaps.

* * * * *